US009966207B1

(12) United States Patent
Cleaveland

(10) Patent No.: US 9,966,207 B1
(45) **Date of Patent: *May 8, 2018**

(54) MOTORIZED HIGH VOLTAGE IN-LINE DISCONNECT SWITCH WITH COMMUNICATION SYSTEM CONTROLS

(71) Applicant: CLEAVELAND/PRICE INC., Trafford, PA (US)

(72) Inventor: Charles M. Cleaveland, North Huntingdon, PA (US)

(73) Assignee: CLEAVELAND/PRICE INC., Trafford, PA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/582,626

(22) Filed: Apr. 29, 2017

Related U.S. Application Data

(60) Provisional application No. 62/412,920, filed on Oct. 26, 2016.

(51) Int. Cl.

| | |
|---|---|
| ***H01H 9/54*** | (2006.01) |
| ***H01H 31/28*** | (2006.01) |
| ***H01H 31/00*** | (2006.01) |
| ***H01H 31/02*** | (2006.01) |
| ***H01H 3/26*** | (2006.01) |
| ***H01H 33/66*** | (2006.01) |

(52) U.S. Cl.
CPC ..... *H01H 9/54* (2013.01); *H01H 3/26* (2013.01); *H01H 31/006* (2013.01); *H01H 31/02* (2013.01); *H01H 31/28* (2013.01); *H01H 33/66* (2013.01); *H01H 2239/044* (2013.01)

(58) Field of Classification Search
CPC ..... H01H 9/54; H01H 3/26; H01H 31/006; H01H 31/02; H01H 31/28; H01H 33/66; H01H 2239/044
See application file for complete search history.

(56) References Cited

U.S. PATENT DOCUMENTS 2,988,610 A * 6/1961 Bernatt ..... H01H 31/28 200/48 A
3,070,680 A * 12/1962 McBride ..... H01H 31/28 200/48 R (Continued)

OTHER PUBLICATIONS

Cleaveland/Price Inc. Bulletin DB-1021B11, entitled "Type ILO-C Hookstick Operated In-Line Transmission Switch 69 kV-230 kV 1200 A.", 4 pages.

*Primary Examiner* — Daniel Cavallari
(74) *Attorney, Agent, or Firm* — Ronald S. Lombard

(57) ABSTRACT

A high voltage in-line air break disconnect switch suspended by an electric power line conductor wherein the switch includes a rotating switch blade that is operated by a communication system controlled motor that may include a switch mounted radio which may be controlled by another radio located at a distance and powered by a solar charged battery. The communication system controlled motorized in-line air break disconnect switch may also be arranged in a three phase installation in a two-way or three-way switching arrangement attached to a utility pole or other structure. The communication system controlled motorized in line air break disconnect switch may in addition be arranged in a phase over phase switching arrangement supported by a utility pole or other structure.

32 Claims, 17 Drawing Sheets

(56) References Cited

U.S. PATENT DOCUMENTS

| | | | | |
|---|---|---|---|---|
| 4,250,362 | A * | 2/1981 | Cookson | H01H 33/166 200/325 |
| 4,492,835 | A | 1/1985 | Turner | |
| 5,641,059 | A * | 6/1997 | Wilde | H01H 5/06 200/400 |
| 6,215,263 | B1 * | 4/2001 | Berkowitz | H01H 33/36 307/139 |
| 6,392,181 | B1 | 5/2002 | Cleaveland et al. | |
| 6,753,492 | B1 | 6/2004 | Cleaveland | |
| 6,762,385 | B1 | 7/2004 | Kowalik et al. | |
| 7,078,642 | B2 | 7/2006 | Kowalik et al. | |
| 9,355,797 | B1 | 5/2016 | Cleaveland et al. | |
| 2015/0243459 | A1 * | 8/2015 | Rhein | H01H 33/127 218/146 |

* cited by examiner

MOTORIZED HIGH VOLTAGE IN-LINE DISCONNECT SWITCH WITH COMMUNICATION SYSTEM CONTROLS

CROSS-REFERENCE TO RELATED APPLICATION

This is application claims the benefit of U.S. Provisional Application No. 62/412,920 filed Oct. 26, 2016, which is incorporated herein by reference in its entirety.

BACKGROUND OF THE INVENTION

The present invention relates generally to an air break disconnect switch for high voltage electrical applications and, more particularly, to an in-line high voltage air break disconnect switch that mounts in-line with the transmission line conductor without the need of a group operated switch with associated ground supported mounting structure. Such an in-line high voltage disconnect switch hangs from and is supported by its associated transmission line.

One example of such an in-line high voltage disconnect switch is a vertical break disconnect switch currently manufactured and sold by Cleaveland/Price Inc., of Trafford, Pa., the present Assignee, as a type ILO-C, Hookstick Operated In-Line Transmission Switch. The switch is described in Cleaveland/Price Bulletin DB-1021611, entitled "Type ILO-C Hookstick Operated In-Line Transmission Switch 69 kV-230 kV 1200 A.". The switch is rated 69 kV-230 kV, 1200 amperes. The Cleaveland/Price Inc. type ILO-C In-Line high voltage disconnect switch utilizes a manually operated hookstick for engaging an operating eye ring attached to the breakjaw end of the switch blade of the switch. The hookstick when engaged with the operating ring imparts rotation to the hinge end of the switch blade for opening and closing of the switch. The Cleaveland/Price Inc. type ILO-C In-Line high voltage disconnect switch is a single phase switch and is versatile and can serve many functions on a three phase system. The switch can be used to sectionalize long transmission lines, disconnect lines from substations, serve as a line tap switch, and serve as a temporary maintenance switch, for example. The Cleaveland/Price Inc. type ILO-C In-Line high voltage disconnect switch saves significant installation costs compared to a non-in-line switch installed via direct ground support mounting structure. The Cleaveland/Price Inc. type ILO-C high voltage disconnect switch allows for easy, cost efficient sectionalizing of high voltage transmission lines and isolation in high voltage substations. As a result of this, the type ILO-C In-Line high voltage disconnect switch has been used by electric utilities for many years to isolate transmission and substation circuits.

In recent years the electric utility industry has been interested in modernizing the electrical power infrastructure. It is therefore an object of this invention to provide an improved in-line high voltage disconnect switch that lends itself to being used in even further applications for automating the electric power grid, than the above-described prior art in-line switch.

SUMMARY OF THE INVENTION

The communication system controlled in-line motorized high voltage disconnect switch of the present invention provides a substantial improvement of the prior art in-line switch. The present invention utilizes the insulator and switch current carrying parts of the above-described Cleaveland/Price Inc. type ILO-C high voltage disconnect switch, but the present invention switch may be operated by a communication system controlled switch mounted motor instead of a hookstick to operate the switch. The communication system may include a plurality of communication devices such as radios. A switch mounted radio commands the motor to open or close the switch for automating the utility system. The radio controlled motorized in-line high voltage disconnect switch of the present invention in one embodiment is configured as a vertical air break disconnect switch and in another embodiment as a side air break disconnect switch. The in-line high voltage disconnect switch is preferably powered by a solar charged battery which also powers the switch mounted radio and a remote terminal unit, i.e., RTU device. Another name for the RTU device is "remote terminal unit". The RTU is a microprocessor-controlled electronic device that interfaces the switch control to a supervisory control and data acquisition system by transmitting telemetry data via the switch mounted radio to a master system, and by using radio messages from the supervisory system to energize the switch mounted motor to open or close the switch.

In a three-phase electric power installation the present invention provides in one embodiment three (3) motorized in-line high voltage disconnect switches, one for each phase, each with a battery and solar panel for charging the battery. A current transformer could also be used to charge the battery in addition to or instead of solar panels as long as current flows in the line. One phase is also provided with a radio for long distance transmitting to an electric utility control room and all three phases may communicate to each other via three (3) short distance radios, one for each phase, which allow the three switches of this embodiment of a three-phase installation to be activated simultaneously.

The switch blade of each of the in-line high voltage disconnect switches of the present invention includes a switch mounted worm gear drive including a worm screw coupled to and activated by the switch motor. A worm gear is operatively attached to the hinge pin and switch blade member of the switch blade at a hinge end of the switch blade and engages the worm screw. When the switch mounted motor is energized the worm gear rotates causing the switch blade member to rotate, as a result causing the switch blade to rotate about the axis of the hinge pin member from the open to the closed position or vice versa. At the opposite end of the switch blade is a contact for contacting a switch break jaw when the switch is closed. In some embodiments of the present invention the transmission line for each of the switches is cut in two or split at the switch. Each in-line high voltage switch includes a polymer strain insulator which is provided with transmission line connection points at opposite ends in the form of clevises and dead-end fittings for respectively mounting each cut end of the transmission line to the polymer insulator which carries the strain load of the line. The in-line high voltage disconnect switch of the present invention therefore hangs on the transmission line. The transmission line at a first cut end is electrically connected to the switch terminal at the hinge end and the transmission line is electrically connected to a switch break jaw terminal at a second cut end.

The improved radio controlled motorized in-line switch of the present invention, desirably includes an eye ring operatively affixed to the worm so that the switch may still be manually turned with a hookstick or hot stick which engages the eye ring. This inclusion of the eye ring is desirable in case the motorized portion of the switch is inoperable electrically.

A housing is mounted at the hinge end of each in-line switch. The housing encloses the worm drive and motor. The housing also typically encloses and supports devices such as, the battery, power and control boards, transformer, switch mounted radio and fuses. On the exterior of the housing one or more solar panels for powering the battery may be mounted. Also one or more radio antennas are mounted to the housing for communication.

The radio controlled motorized in-line high voltage disconnect switches of the present invention do not require a dedicated structure to mount the switches in a traditional manner, such as mounted to a metal framework, which is expected to result in advantageous commercial value for electric utilities that are automating their systems. By eliminating the traditional dedicated mounting support structures obvious cost savings may be realized.

In an alternative embodiment, the above-mentioned three (3) short distance switch mounted radios may communicate with a short range radio housed in an enclosure at ground level which allows local operation of the three (3) motorized in-line high voltage disconnect switches from local controls at ground level and allows operation via the utility communication network between a ground level long distance radio and the utility control room radio. The ground level long range radio allows longer distance transmitting and a much larger solar panel mounted on the ground level enclosure, than switch mounted solar panels, allows collecting solar power in an area with little sun light or the long range radio mounted at ground level may be powered by a local AC source.

In other alternative embodiments, the radio controlled motorized in-line switch of the present invention may be used in a 3-way or 2-way switch assembly arrangement utilizing a utility pole for support in a three phase side by side switching arrangement or in a phase over phase, three phase arrangement. In a 3-way switch assembly arrangement, three of the radio controlled motorized in-line switches would be used per phase to route power in any one of three different directions. Each radio controlled motorized in-line switch includes a switch mounted short distance radio and each three phase arrangement also includes one long distance radio to communicate with the utility control room radio. In a ground level arrangement case, a short distance radio and the long distance radio will be housed in the ground level housing. The ground level long range radio will have the capability to communicate with an additional radio located at a distance in an electric utility control room. The three or two switches per phase may be radio controlled to open and close the switches simultaneously or independently as desired to route power in different directions or isolate a circuit for maintenance.

The radio controlled motorized in-line switch of the present invention may also include a quick break whip or a vacuum interrupter in order to interrupt current. Another embodiment of the communication system to simultaneously operate all three phases together could be a fiber optic connection between phases or phase to ground, not shown in the drawings, instead of the use of radio control.

These and other aspects of the present invention will be further understood from the detailed description of the particular embodiments, drawings and claims.

DETAILED DESCRIPTION OF THE PARTICULAR EMBODIMENTS

Figure 2:
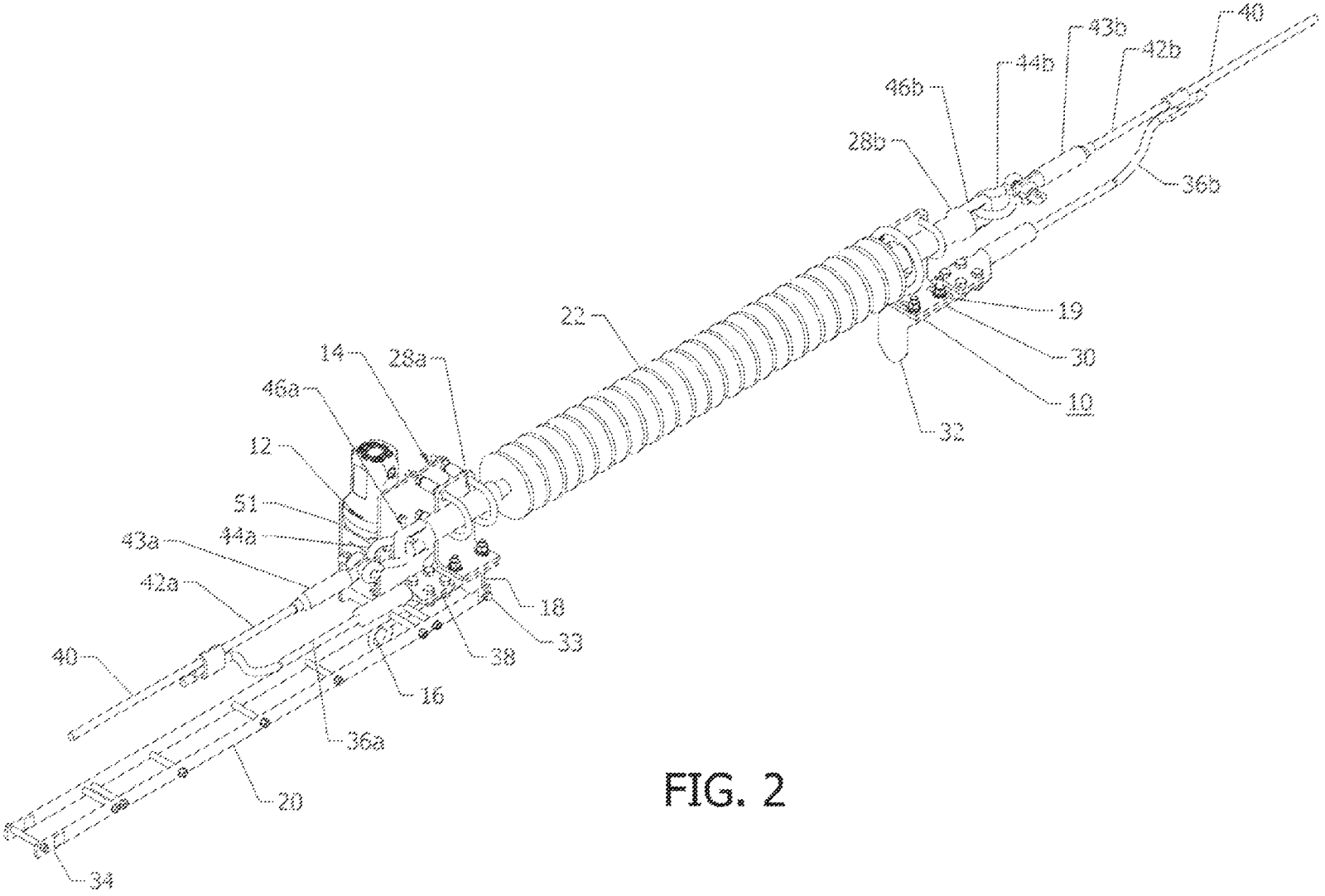
FIG. 2 is the same switch shown in FIG. 1 with the switch open.
Figure 3:
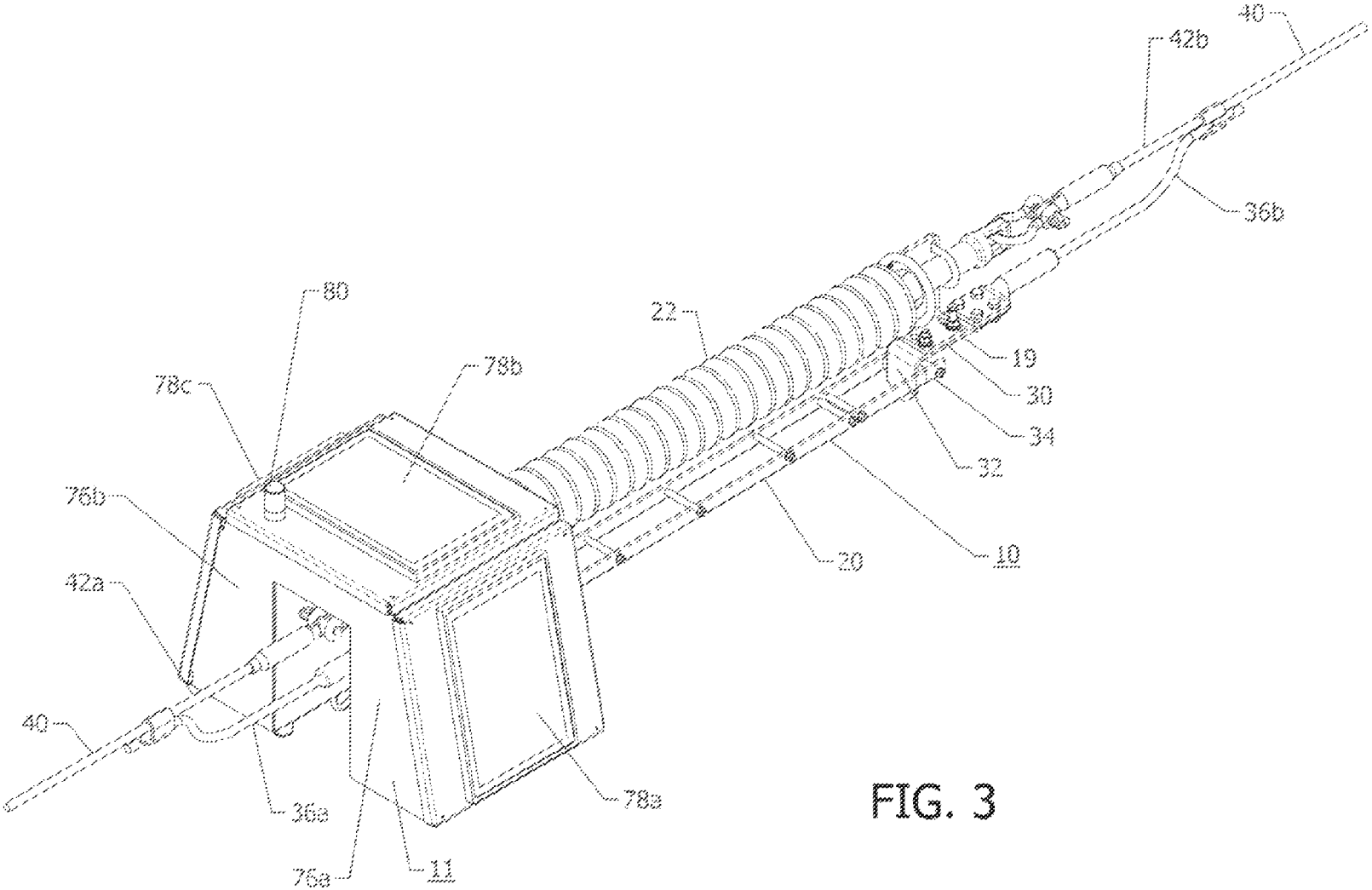
FIG. 3 is a perspective view of the in-line high voltage vertical break disconnect switch of the present invention showing the housing mounted at the hinge end of the switch with solar panels attached to the housing and the switch blade in the closed position.
Figure 4:
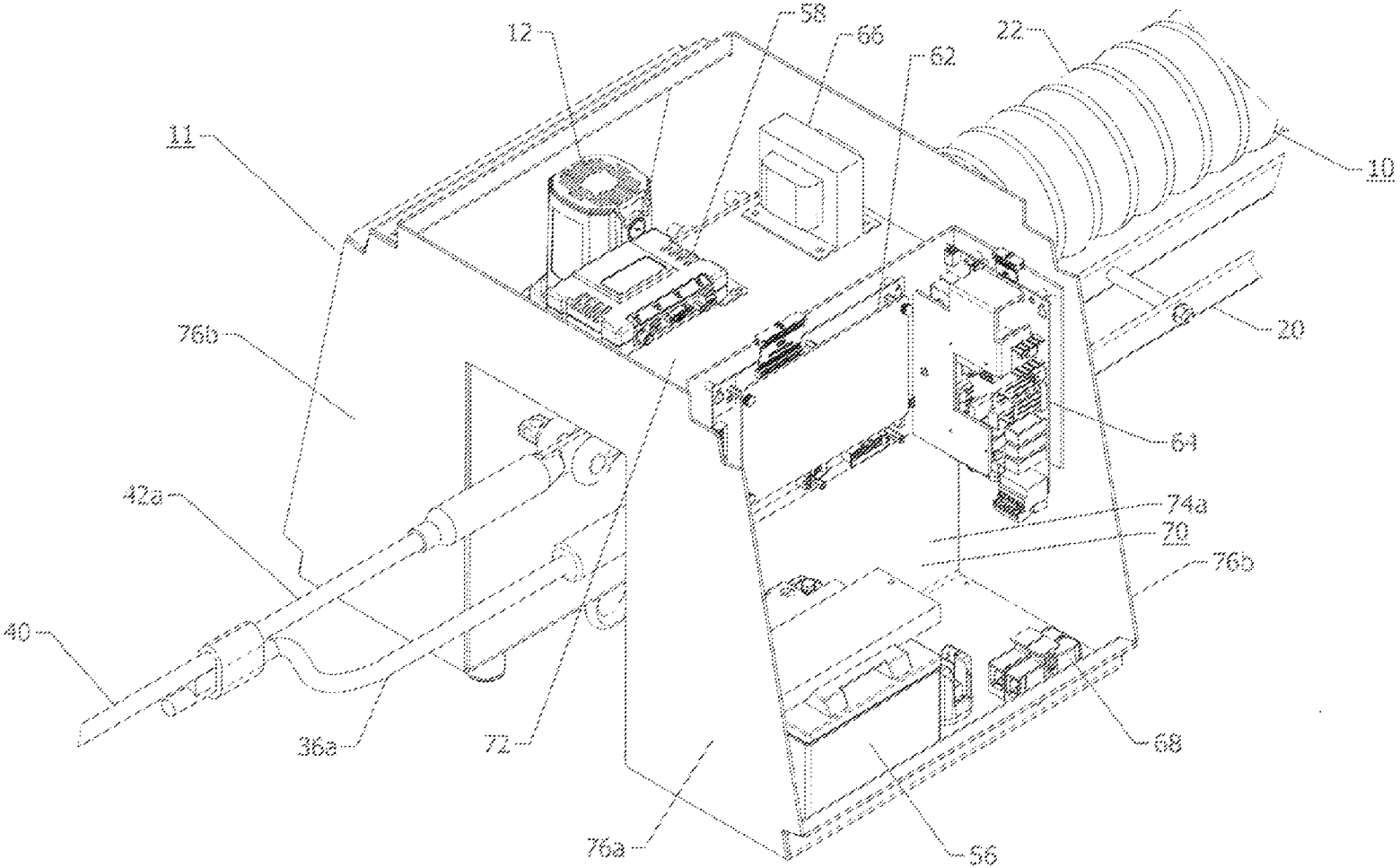
FIG. 4 is a partial perspective view of the in-line high voltage vertical break disconnect switch of the switch shown in FIG. 3 of the present invention at the hinge end showing the components mounted within the housing with two of the solar panels removed.

FIGS. 1-7A show one embodiment of the radio controlled motorized in-line air break disconnect switch 10 of the present invention, which in this embodiment is a vertical break disconnect switch. FIG. 4 depicts the switch 10 with the housing 11 enclosing a motor 12. The housing 11 is removed at the rotating hinge contact end 14 of the disconnect switch 10 in FIGS. 1 and 2. The radio controlled motorized in-line vertical air break switch 10 of the present invention depicted in FIGS. 1-7A, as mentioned, is an improvement over the in-line vertical break disconnect switch, type ILO-C currently manufactured and sold by Cleaveland/Price Inc., of Trafford, Pa., the present Assignee, which is a hookstick operated transmission switch. The communication system controlled in-line air break disconnect switch 10 of the present invention includes the following components in common with the Cleaveland/Price Inc. type ILO-C in-line vertical air break disconnect switch. As mentioned with the type ILO-C disconnect switch is manually operated by a hookstick, not shown in the Figures. The hookstick effort imparts rotation to the switch blade 20 for opening and closing the vertical air break in-line disconnect switch 10. The in-line disconnect switch 10 of the present invention utilizes the polymer strain insulator 22 and other switch current carrying parts of the Cleaveland/Price Inc. type ILO-C prior art switch.

Figure 1:
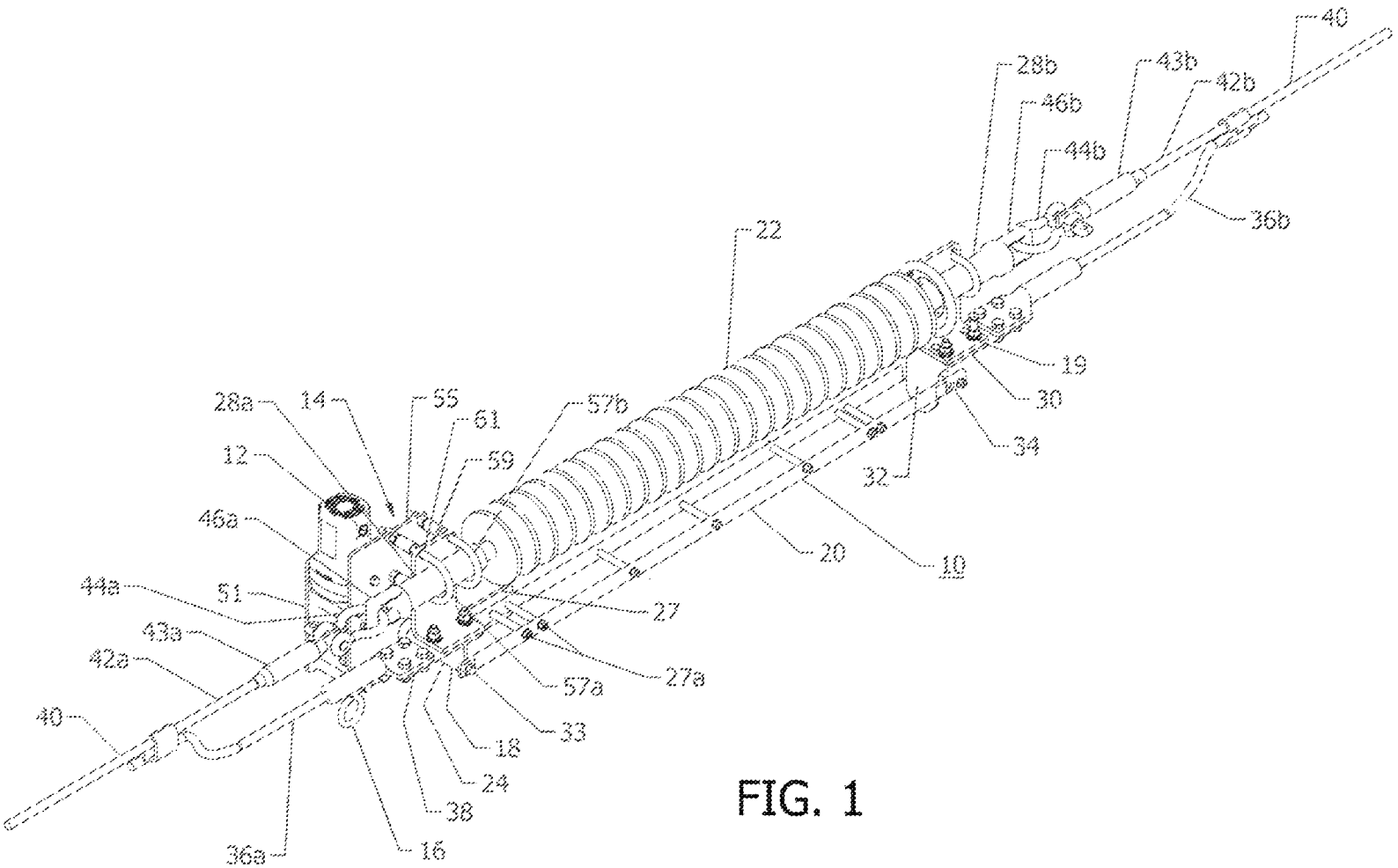
FIG. 1 is a perspective view of the motorized in-line high voltage vertical break disconnect switch of the present invention with the housing removed, showing the switch in the closed position.

As shown in FIGS. 1 and 2 the other common switch current carrying parts includes in this embodiment the vertically rotating switch blade 20. A hinge contact member 24 is included at the hinge end 18 of the switch 10 and is connected in circuit to a hinge terminal 38. The hinge contact member 24 includes a hinge pin 33 that switch blade 20 rotates about. The hinge end 18 of the switch 10 is mounted proximate one end 28*a* of the strain insulator 22. The switch 10 also includes a break jaw end 19 which is mounted proximate the other end 28*b* of the strain insulator 22 and a switch break jaw contact terminal 30. The switch break jaw contact terminal 30 includes an integral breakjaw contact 32 for contacting the switch blade end 34 when the switch is closed. The switch 10 also includes jumpers 36*a*, 36*b* attached in the circuit respectively, to a hinge terminal 38 and the switch break jaw terminal 30. As shown in FIG. 1, a transmission line 40 has been cut, resulting in two transmission line ends 42*a*, 42*b*. Each transmission line end 42*a*, 42*b* is respectively attached to strain cable fittings 43*a*, 43*b* and to shackles 44*a*, 44*b*. The present invention applies to electric power lines including transmission lines and distribution lines, for example. The shackles 44*a*, 44*b* respectively engage chain eye end fittings 46*a*, 46*b* at the ends 28*a*, 28*b* of the strain insulator 22. The transmission line 40 may support the in-line vertical air break disconnect switch 10 without the switch 10 being attached directly to a dedicated support structure, such as metal framework. The jumpers 36*a*, 36*b* carry the transmission line current in circuit with the switch blade 20 via the contacts 32 and 24.

Figure 5:
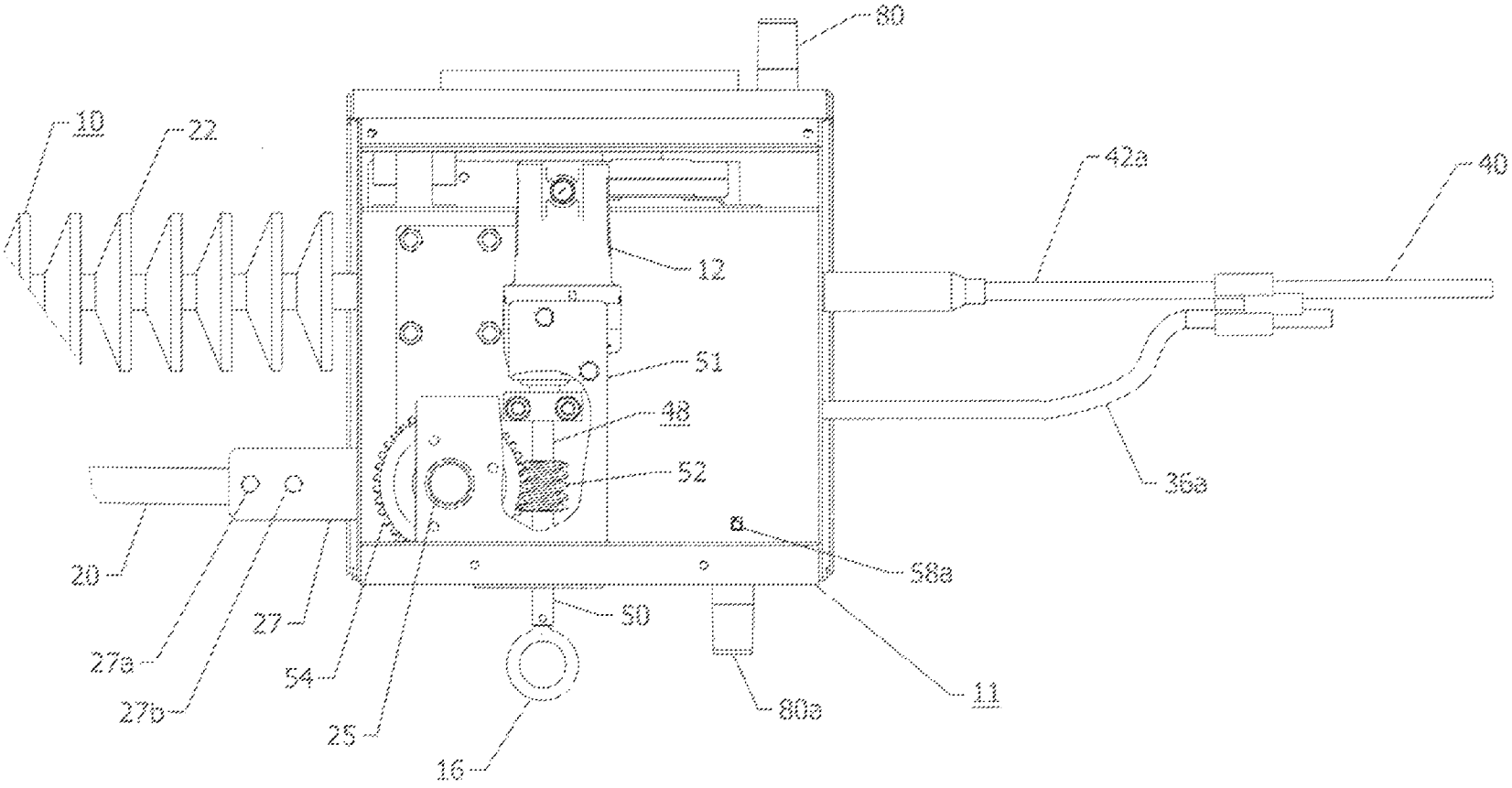
FIG. 5 is a side view of the hinge end of the switch of FIG. 4 looking from the opposite side of the switch with the solar panel removed.
Figure 6:
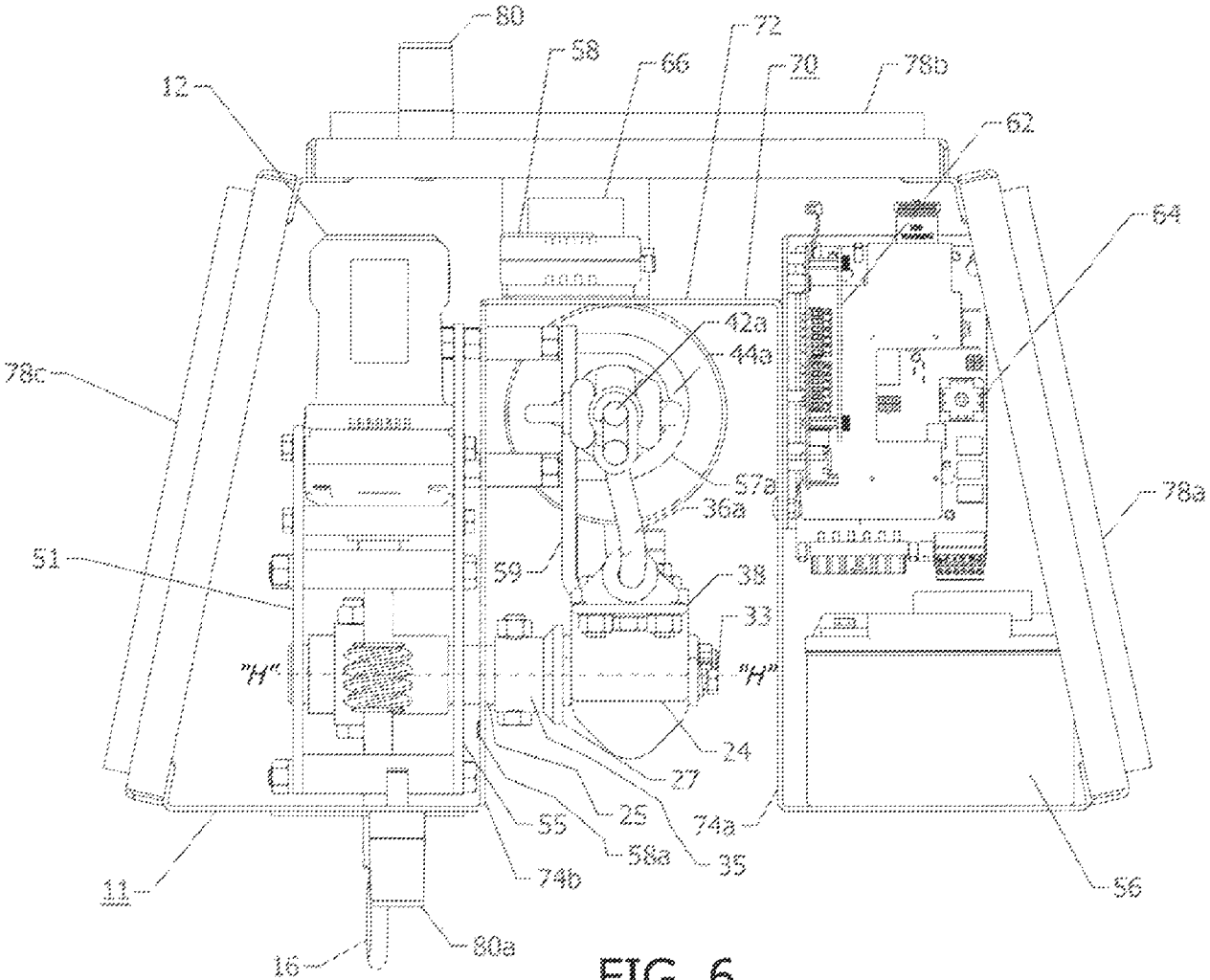
FIG. 6 is an end view of the hinge end of the in-line high voltage disconnect switch of the present invention as shown in FIG. 3 with the housing end sheets removed.
Figure 7A:
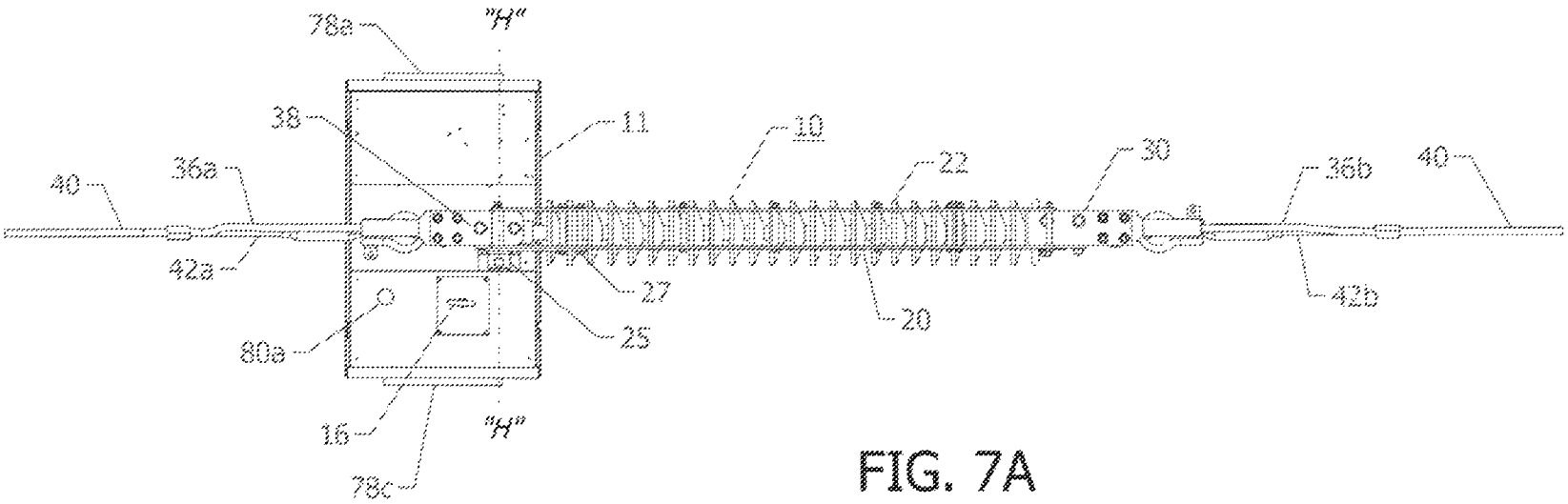
FIG. 7A is a view of FIG. 3 of the switch of the present invention looking up from the ground to the underside without the addition of a current transformer.
Figure 7B:
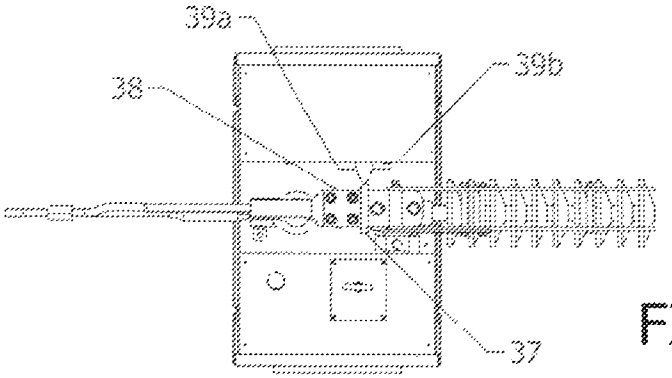
FIG. 7B is the same as FIG. 7A but with the addition of a current transformer.

The motorized in-line vertical air break disconnect switch 10 in addition to the these common current carrying parts with the type ILO-C in-line Cleaveland/Price Inc. air break disconnect switch also, include the following additional components. The motor 12 is included for driving a worm drive 48, which as shown for example in FIG. 5. The worm drive 48 includes shaft 50 of the motor 12 operatively attached to a worm 52 carried by the worm shaft 50, which is in operative engagement with a worm gear 54 carried on the output shaft 25 which is axially aligned with the rotating hinge axis "H" shown in FIG. 7A. The shaft 25 is connected via bolted hub 35 to drive bar 27 which is connected at bolts 27*a*, 27*b* to the switch blade 20 for rotational motion shown in FIGS. 5 and 6. The motor 12 is carried on a motor mounting 51 as shown in FIG. 6. The motor mounting 51 is attached to plate 55 which carries U-bolts 57*a*, 57*b* as shown in FIGS. 1 and 6. The motor 12 may be a type AC/DC having a ¾ horsepower rating, for example. The U-bolts 57*a*, 57*b* pass through apertures 61 in L-shaped bracket 59, shown in FIG. 1. The one end 28*a* of the strain insulator 22 passes through the U-bolts 57*a*, 57*b* as shown in FIG. 1. FIGS. 5 and 6 show a manual operating eye ring 16 is attached at the end of the worm shaft 50 for cooperating with a hookstick, not shown, in case the motor 12 is inoperable. The in-line high voltage disconnect switch 10 as mentioned is powered by a solar charged battery 56 attached to housing 11, as shown in FIGS. 4 and 6. The solar charged battery 56 powers the motor 12, and also a switch mounted short range radio 58*a* and possibly a long range radio 58. The housing 11 also carries a control board with RTU 62, a power board 64, a transformer 66 and fuses 68 which are also powered by the solar charged battery 56. These switch components operate as follows:

The utility control center may desire to open or close the switch 10 by way of sending a radio command to the long range radio 58 in one phase of a three phase switching arrangement and the signal is translated via the RTU, i.e., remote terminal unit, to operate the contacts, not shown, on the control board 62 which energizes the motor 12 to turn either forwards or backwards to open or close the switch 10. The power board 64 takes power from the solar panels 78*a*, 78*b*, 78*c* shown in FIG. 3 and charges the battery 56 at a rate that does not over charge the battery to run the motor 12 at 125 VDC. The power board 64 includes an inverter, not shown, that converts 12 VDC to AC. Then the transformer 66 raises the voltage to 125 VAC which is rectified by the power board 64 to 125 VDC. The fuses 68 protect the circuit. The short range radio 58*a* shown in FIGS. 5 and 6 in each phase communicates to cause all three switches to open simultaneously or otherwise as desired. A current transformer 37, as shown in FIG. 7B, may be mounted around the hinge terminal 38 and can be used to provide additional power to charge the battery 56 via current transformer leads 39*a*, 39*b* which are connected to power board 64 in circuit with the battery, the connection to the power board 64 is not shown in the drawings.

As seen in FIG. 6, the housing 11 in one embodiment includes an inverted U-shaped inner housing panel 70. The inverted U-shaped inner housing panel 70 includes a top panel 72 and two oppositely disposed L-shaped panels 74*a*, 74*b* which extend respectively on opposite sides of the top panel 72. As can be seen by reference to FIGS. 4 and 6, the switch mounted long range radio 58 and transformer 66 may be attached, for example, to the top panel 72. The control board 62, solar charged battery 56, and fuses 68 are mounted to the first L-shaped panel 74*a*. The motor 12 is supported by the motor mountings 51 and 55 which are positioned as shown in FIG. 6 attached to the second L-shaped panel 74*b*. The housing 11, in this embodiment, also includes a first end wall 76*a* and a second end wall 76*b* which are attached as shown in FIG. 4 to the inverted U-shaped inner housing panel 70. The housing 11, in this embodiment, also includes three solar panels 78*a*, 78*b*, and 78*c*, or more, attached between the first and second end walls 76*a*, 76*b*, as shown in FIGS. 3 and 6, for example. A radio antenna 80 in operative arrangement with the switch mounted long range radio 58 is mounted near solar panel 78*b* and antenna 80*a* for the short range radio 58*a* is mounted on the underside of the housing 11 as shown in FIG. 6. As shown for example in FIGS. 4-7A, when the housing 11 is maintained in position over the hinge end 18 of the switch 10, the solar panels 78*a*, 78*b*, and 78*c*, in addition to powering the battery 56, act as protective weather shields for the previously described components carried within housing 11 and for the rotating hinge contact 24.

Figure 8:
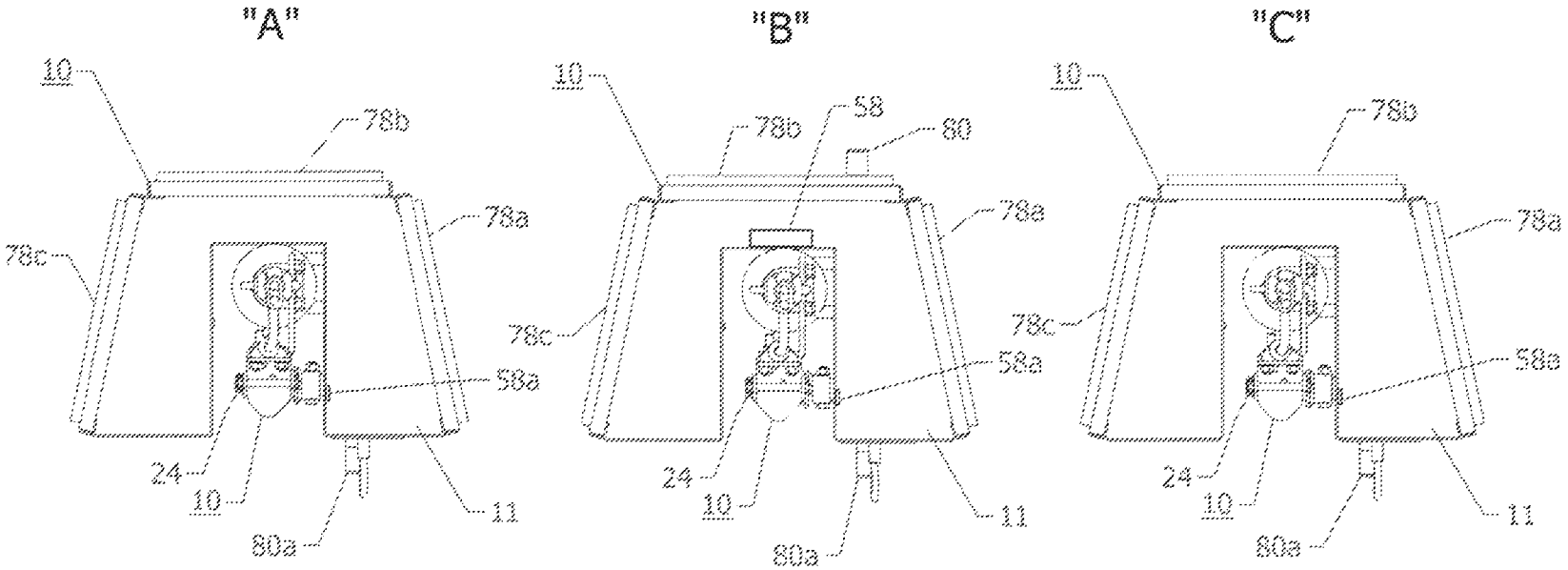
FIG. 8 is a schematic showing the present invention in end view with phases A, B, and C of the electric system.

FIG. 8 shows schematically hinge end elevation views of three radio controlled motorized in-line air break disconnect switches 10 of the present invention. The vertical break disconnect switch 10 of this embodiment is operatively arranged on the phases 'A', 'B', and 'C' of an electric utility system. Each switch 10 of the three phases 'A', 'B', and 'C' may contain, as mentioned, a switch mounted short range radio 58*a*, as also shown in FIG. 5, which utilizes attached radio antenna 80*a* to communicate with the other phases. Also, one of the switches 10 may be provided with a first long range radio 58, also shown in FIGS. 4 and 6 for distance transmitting to a utility control room long range radio 89 via antenna 87 housed in a utility control room 90 which may be located at a distance, see FIG. 9. The three switches 10 mounted in the three phases 'A', 'B', and 'C' communicate with each other via the three short range switch mounted radios 58*a*; which allow the three switches 10 of the three phases 'A', 'B', and 'C' to be actuated simultaneously, for example, if desired. The present invention is very beneficial for electric utilities because, as mentioned, there is no need for a dedicated ground supported structure to mount switches in a traditional manner.

Figure 9:
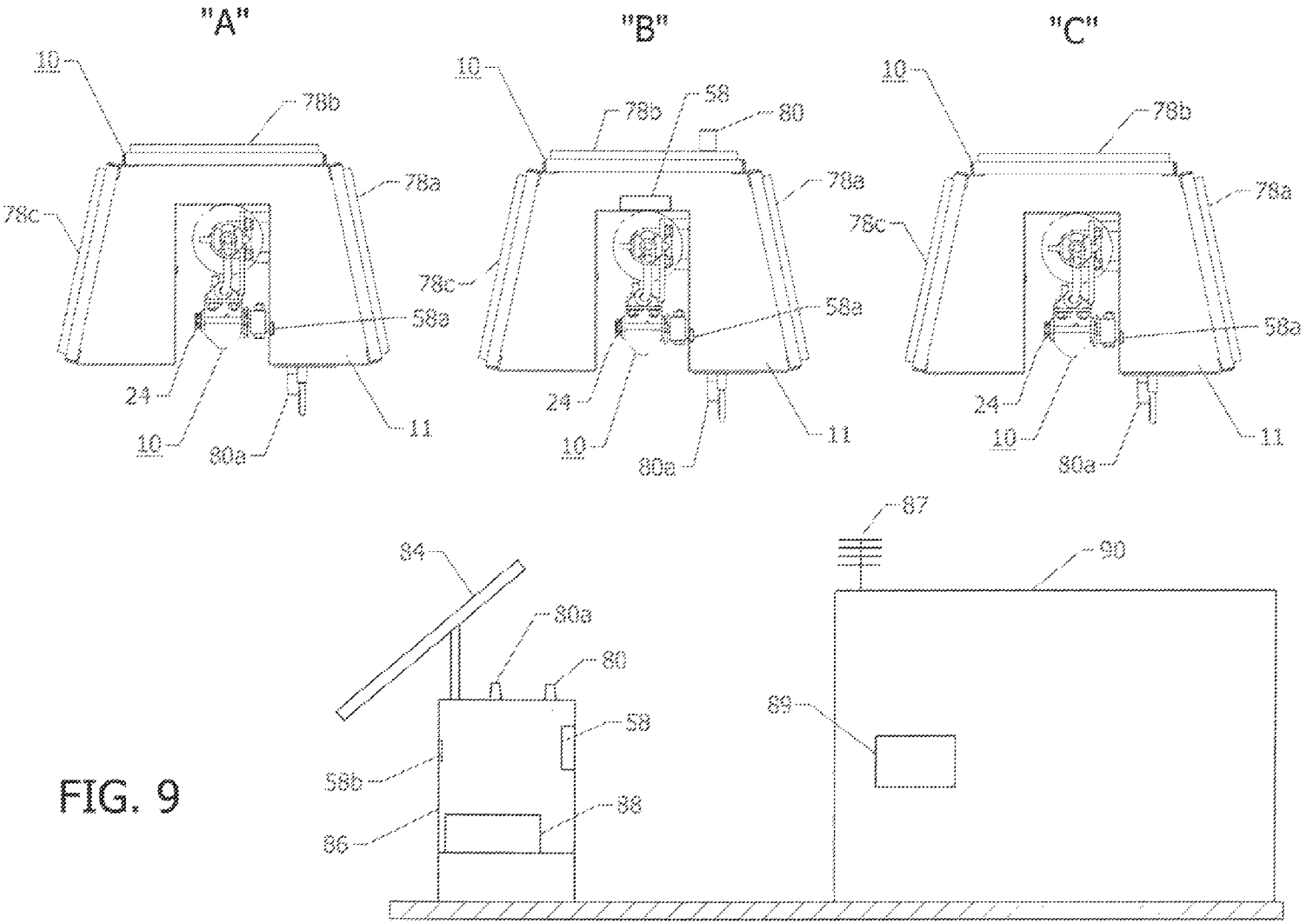
FIG. 9 is the same as FIG. 8, but a larger solar panel and the higher power long range radio and larger battery are disposed at ground level to the enclosure and also shown is the utility control room.

FIG. 9 shows the same three phase switch arrangement as FIG. 8, but a larger solar panel 84 is mounted as shown to a ground level enclosure 86 which houses longer range radio 88. This embodiment allows the three switch mounted short range radios 58*a* to communicate with short range radio 58*b* mounted in enclosure 86 to allow local operation at ground level to actuate simultaneously or in any order desired the three switches 10 of the three phases 'A', 'B', and 'C'. The larger solar panel 84 is useful for areas with less sun power and to power the longer range radio 88 which requires more power than radio 58.

Figures 10A, 10B:
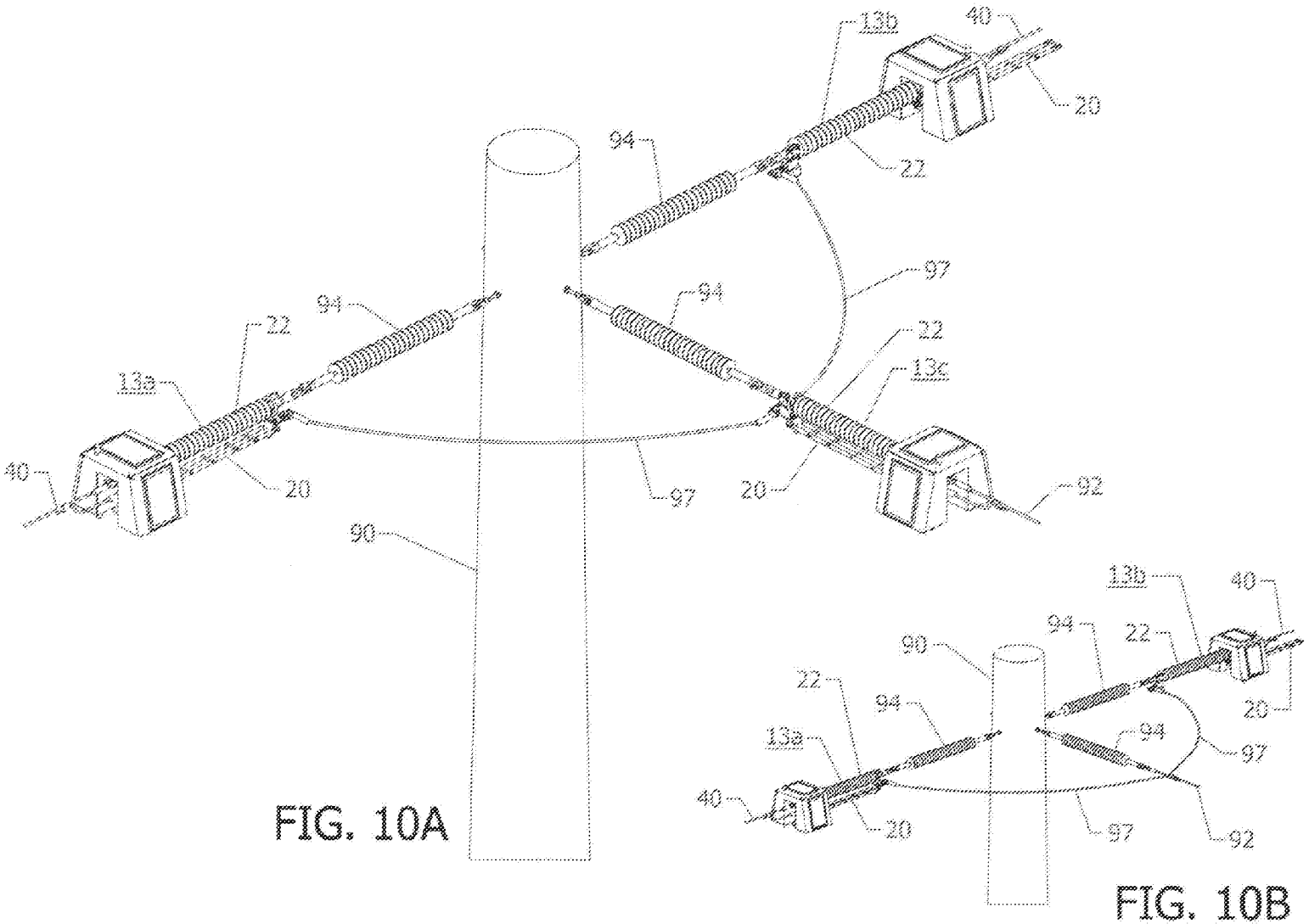
FIG. 10A is a perspective view of one phase of the 3-way switching arrangement of the present invention supported by a utility pole with two switches closed and one switch open.
FIG. 10B is a perspective view of one phase of the 2-way switching arrangement of the present invention supported by a utility pole with one switch closed and one switch open and a conductor to transmit power to either switch.

FIG. 10A shows one phase of a three phase installation of a 3-way switching arrangement of the present invention supported by a utility pole 90. The switching arrangement shown in FIG. 10A includes three vertical air break motorized in-line switches, which in this embodiment are identified as switches 13*a*, 13*b* and 13*c*, which are each suspended in part by the utility pole 90. The transmission line 40 may be cut as shown in FIG. 10A attached to switches 13*a* and 13*b* with a second transmission line 92 attached to switch 13*c*. FIG. 10A shows switches 13*a* and 13*c* in the closed position while switch 13*b* is in the open position. Also, three polymer strain insulators 94 suspend each switch 13*a*, 13*b*, 13*c* to the pole 90, via traditional hardware. Jumpers 97 electrically connect switches 13*a*, 13*b* and 13*c* together. Thus, power can be routed in three different directions. This arrangement would also work for a 2-way switching arrangement, shown in FIG. 10B which is similar to 10A except without switch 13*c*. These switching arrangements form a two way or three way switch array. For further reference regarding two-way or three-way high voltage switching see U.S. Pat. No. 9,355,797 B1, entitled Unitized Phase Over Phase Two-Way or Three-Way High Voltage Switch Assembly with One Vacuum Interrupter Per Phase, issued Mar. 29, 2015, with one of the joint inventors being Charles M. Cleaveland, the present inventor, which is assigned to the present Assignee, Cleaveland/Price Inc. and which is herein incorporated by reference in its entirety as though fully set forth.

Figure 11:
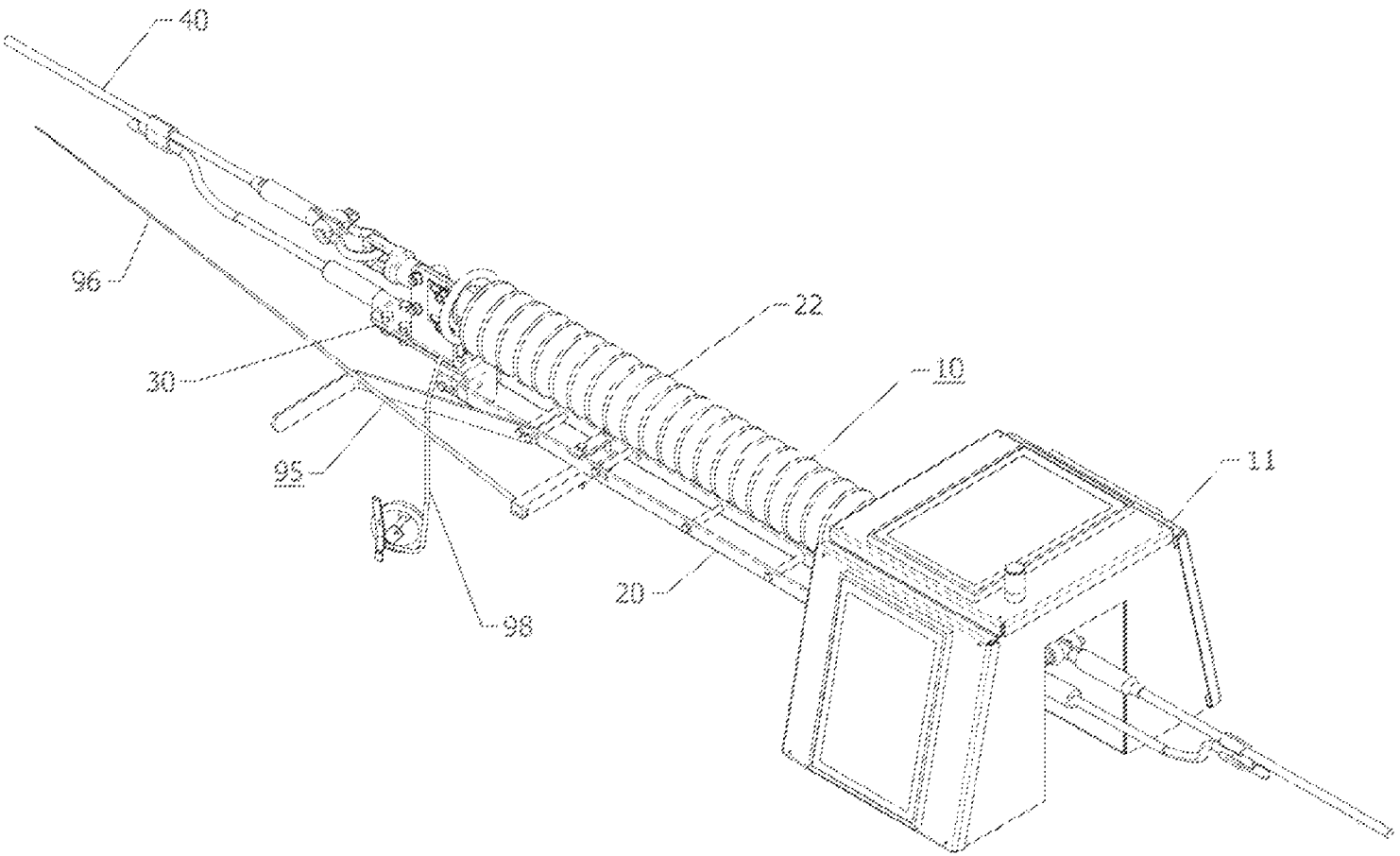
FIG. 11 is a perspective view of an in-line vertical break disconnect switch of the present invention carrying a quick break whip, showing the switch in the closed position.

FIG. 11 shows the radio controlled motorized in-line vertical break switch 10 of the present invention includes an arc extinguishing device 95 which includes a quick break whip 96 attached to blade 20. The arc extinguishing device 95 includes a stationary contact latch member 98 attached to switch break jaw terminal 30. This device allows long transmission lines to be interrupted. For further reference regarding quick break whips, see U.S. Pat. No. 6,392,181 B1, issued May 21, 2002, including joint inventors of which one was the present inventor, Charles M. Cleaveland and assigned to Cleaveland/Price Inc., the present Assignee, Also see U.S. Pat. No. 6,753,492 B1, issued Jun. 22, 2004, by the present inventor, assigned to Cleaveland/Price Inc., the present Assignee. Also see U.S. Pat. No. 6,762,385 B1, issued Jul. 13, 2004, including joint inventors of which one was the present inventor, assigned to Cleaveland/Price Inc. the present Assignee. Also see U.S. Pat. No. 7,078,642 B2, issued Jul. 18, 2006, including joint inventors of which one was the present inventor, assigned to Cleveland/Price Inc., the present Assignee. All of the above-mentioned patents, i.e., U.S. Pat. No. 6,392,181 B1; U.S. Pat. No. 6,753,492 B1; U.S. Pat. No. 6,762,385 B1; U.S. Pat. No. 7,078,642 B2 are incorporated herein by reference in their entireties which describe quick break whip art which is assigned to the present Assignee.

Figure 12:
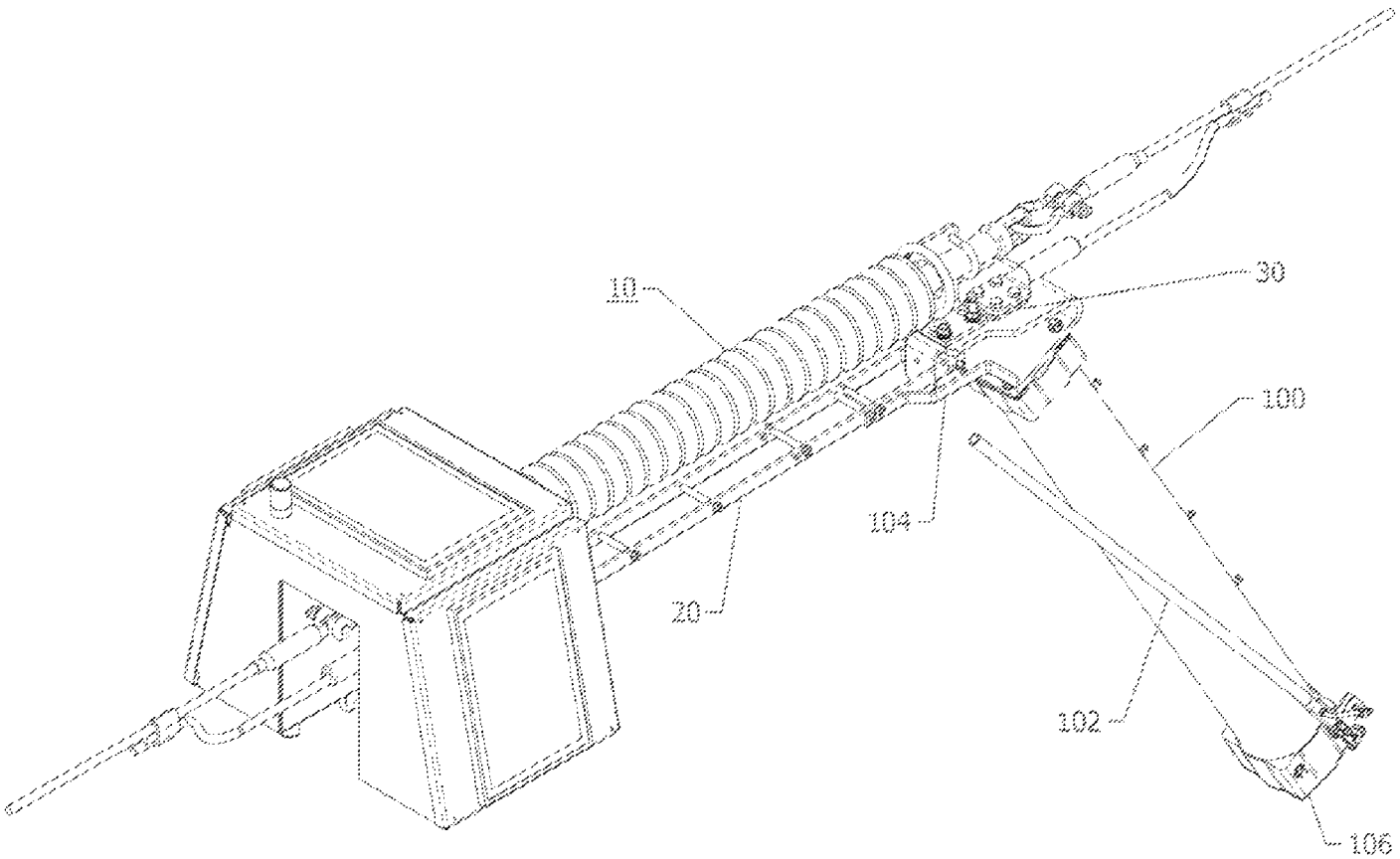
FIG. 12 is a perspective view of an in-line vertical break disconnect switch of the present invention carrying a vacuum interrupter, showing the switch in the closed position.

FIG. 12 shows the radio controlled motorized in-line vertical break switch 10 of the present invention including a vacuum interrupter 100 attached to the switch break jaw terminal 30. Such vacuum interrupter devices including multiple vacuum bottles connected in series circuit arrangement to extinguish an arc are well known, such as described in U.S. Pat. No. 4,492,835 to John L. Turner, issued Jan. 8, 1985. As the blade 20 rotates the actuating arm 102 of the vacuum interrupter 100 is contacted by the moving arc horn 104 for tripping the internal mechanism of the vacuum interrupter, not shown in the drawings. The housing 106 of the vacuum interrupter 100 contains the internal mechanism.

Figure 13A:
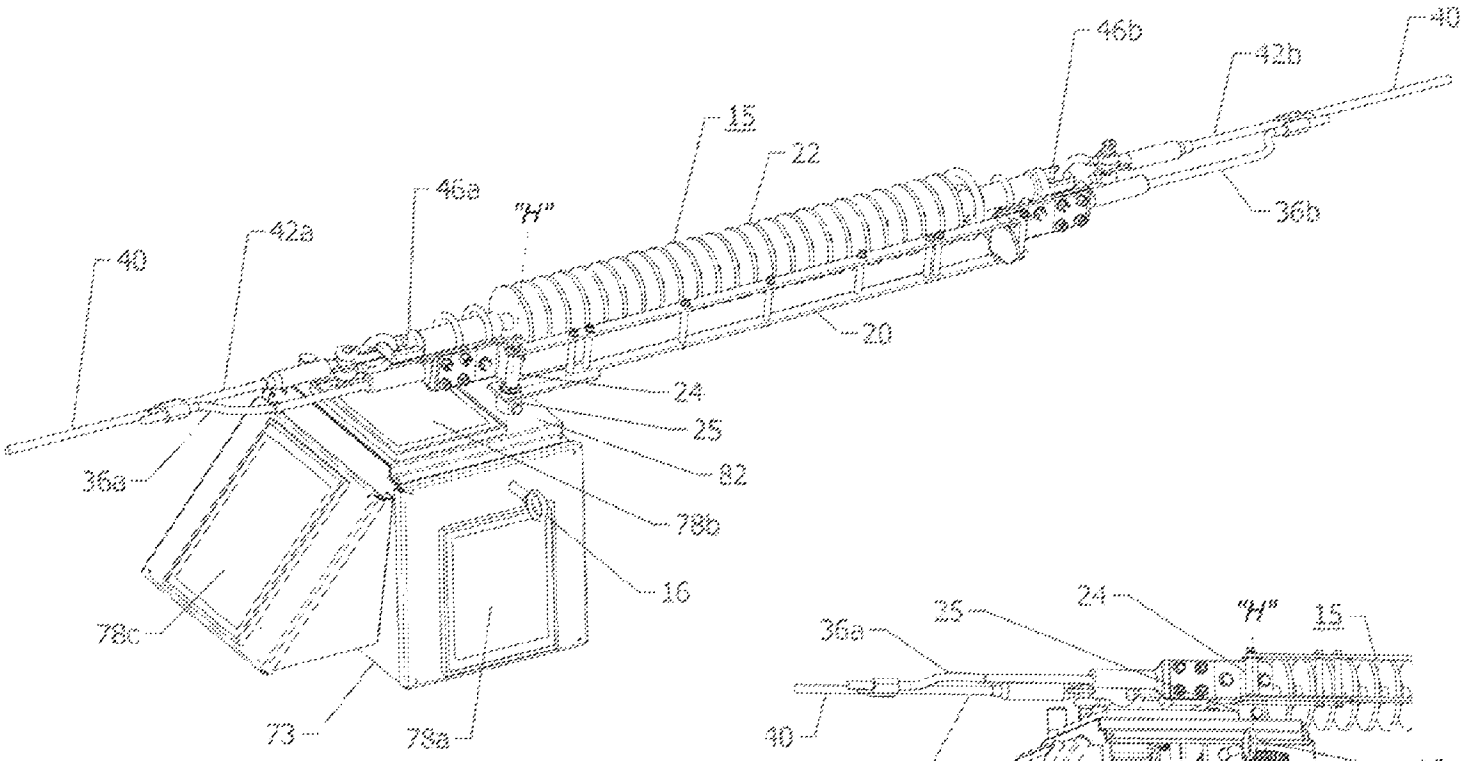
FIG. 13A is a perspective view of an in-line side break disconnect switch of the present invention, showing the switch in the closed position.
Figure 13B:
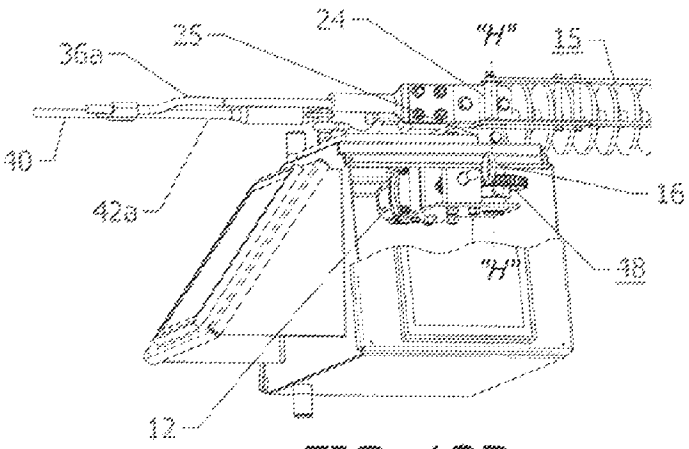
FIG. 13B is a cut away view of an in-line side break disconnect switch of the present invention shown in FIG. 13A, showing the motor and worm drive.
Figure 14:
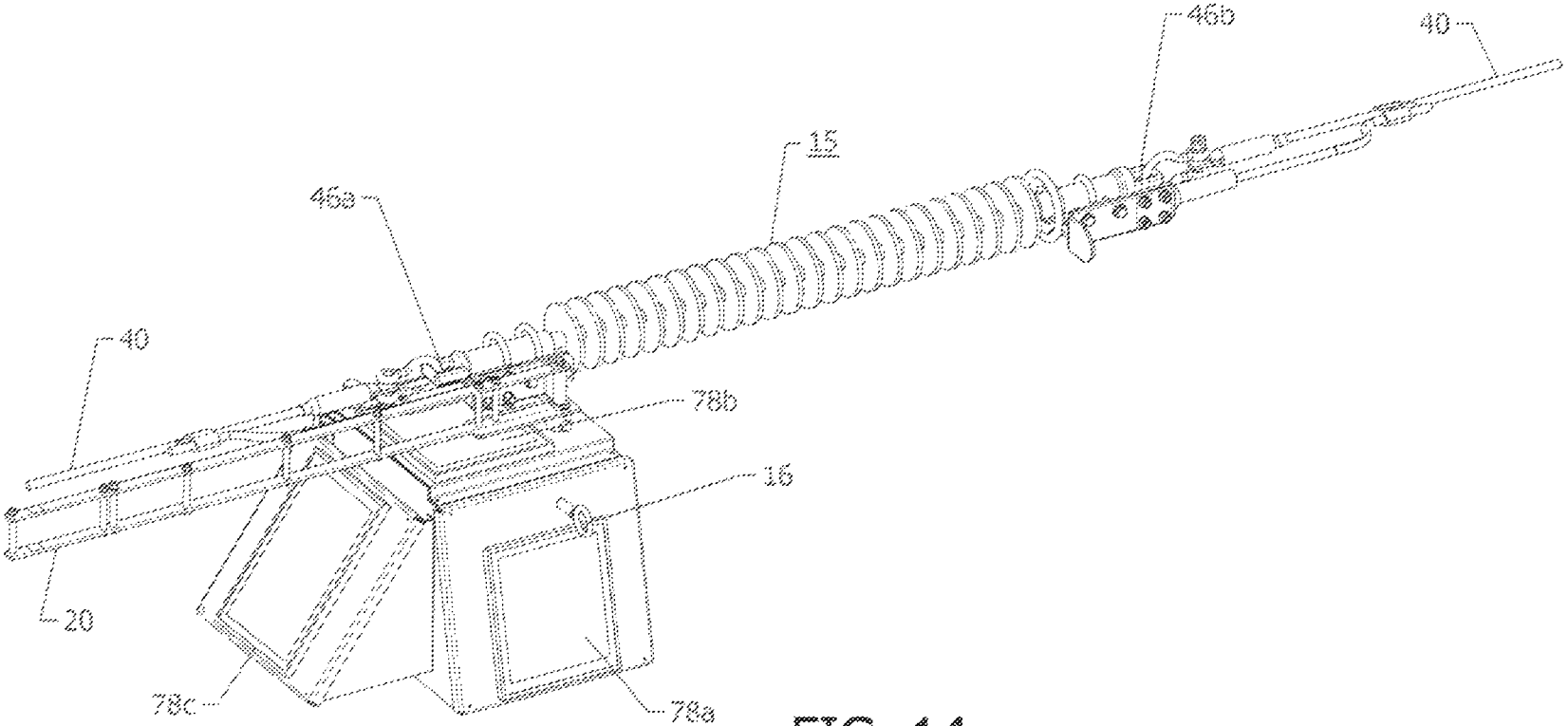
FIG. 14 is a perspective view of an in-line side break disconnect switch of the present invention, showing the switch in the open position.

An alternative embodiment of the motorized in-line air break disconnect switch 10 of the present invention is shown for example, in FIGS. 13A and 14, which is shown as a side break switch 15. The side break switch 15 of the present invention has identical motor drive components as described for the vertical break switch 10, the side break switch 15 having been rotated 90° as shown in FIG. 13A. The switch blade 20 and other current carrying parts are carried above the modified housing 11. FIG. 13B shows a cut away view of the motor 12 and worm drive 48 with hookstick eye 16 for manual operation. The output shaft 25 is arranged vertically so that it is coaxially aligned with the vertical hinge axis "H". Another solar panel 78*c* has been attached to the end side 73 of the housing 11, shown in FIG. 13A. The housing 11 in this embodiment includes also a roof 82 and solar panel 78*b* and panel 78*a* and far side solar panel 78*d*, not shown. The side break switch 15 swings horizontally between the closed and opened positions of the switch as can be seen by comparing FIGS. 13A and 14.

Figure 15:
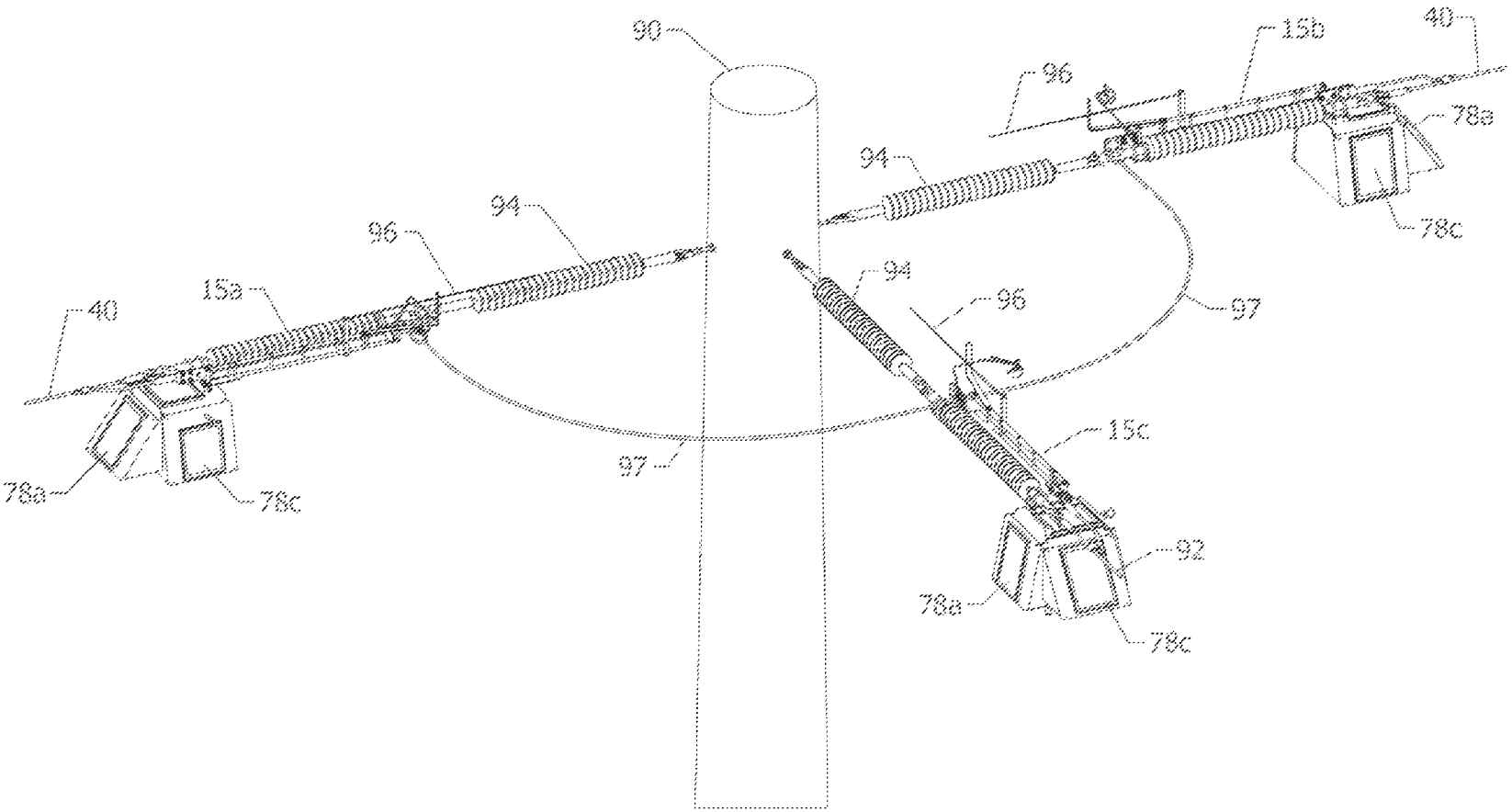
FIG. 15 is a perspective view of a single phase 3-way switching arrangement utilizing three in-line side break disconnects switches shown in the closed position each carrying a quick break whip.
Figure 16:
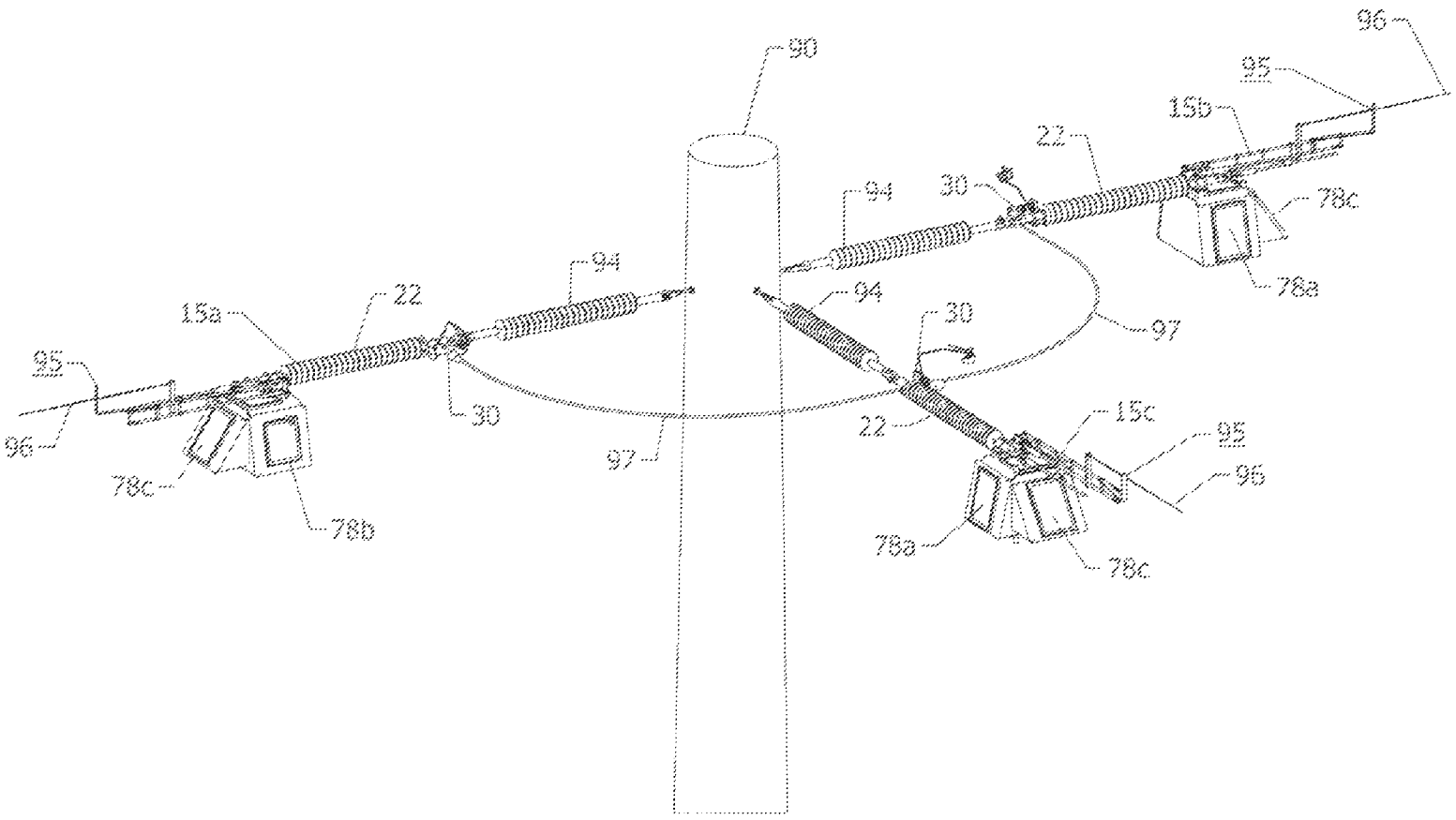
FIG. 16 is a perspective view of a single phase 3-way switching arrangement utilizing three in-line side break disconnects switches shown in the open position each carrying a quick break whip; and, FIG. 17 is a perspective view of a three phase, phase over phase, 3-way switching arrangement utilizing three in-line side break disconnects switches per phase each switch shown in the closed position and each carrying a quick break whip.

FIGS. 15 and 16 shows an arrangement of three side break switches of the present invention forming a 3-way switching arrangement, for a single phase, supported by a utility pole 90 or lattice structure, not shown in the drawings. The switching arrangement shown in FIGS. 15 and 16 includes three radio controlled side break motorized in-line switches, which in this embodiment are identified as switches 15*a*, 15*b* and 15*c*. Each side break switch carries arc extinguishing devices 95 including a quick break whip 96 as previously described. Switches 15*a*, 15*b* and 15*c* are shown in the closed position in FIG. 15 and shown in the open position in FIG. 16. Conductors 97 connect the three switches 15*a*, 15*b*, 15*c* electrically for routing power in different directions.

Figure 17:
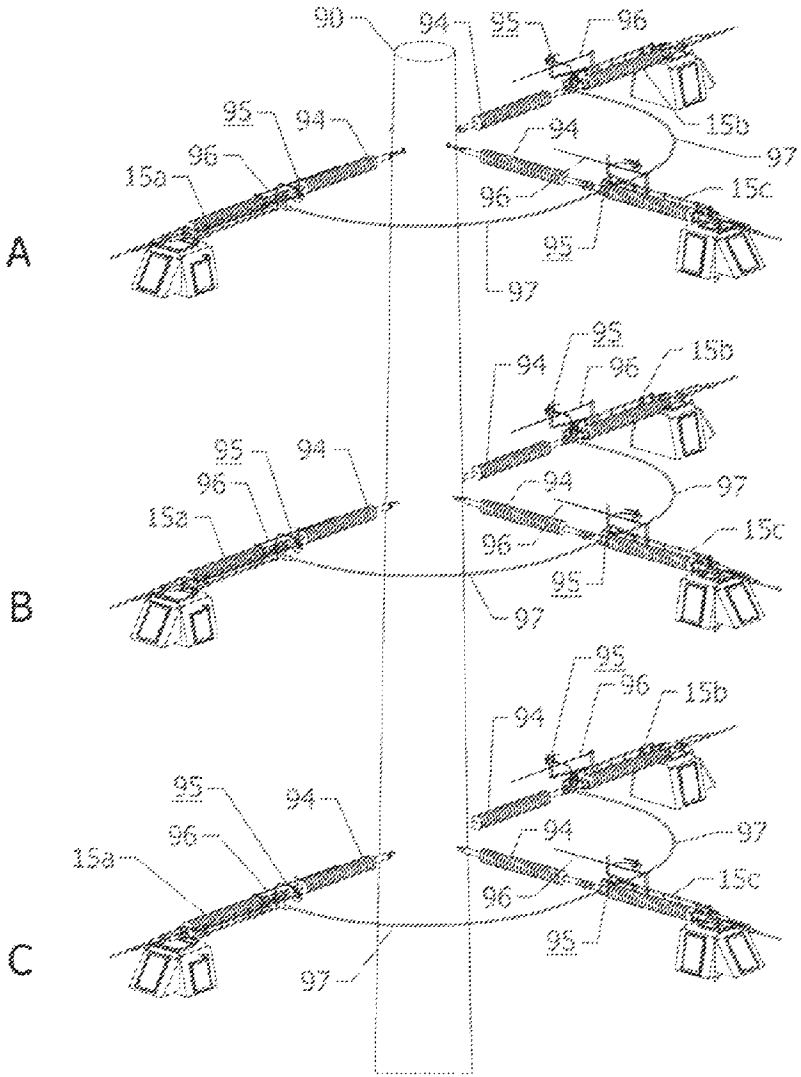

FIG. 17 shows the present invention in a three phase 'A', 'B', and 'C', phase over phase array, mounted to a utility pole 90. Each of the phases 'A', 'B', and 'C' includes a three-way switching arrangement. A two-way switching arrangement is also feasible and similar to FIG. 10B but is not shown in the drawings. For further reference in this regard see the previously mentioned U.S. Pat. No. 9,355,797 B1. Each phase includes, for example, three radio controlled in-line side air break switches 15*a*, 15*b*, and 15*c* of the present invention configured as shown in FIG. 17. Each of the switches includes the arc extinguishing devices 95 including a quick break whip 96 as previously described. All nine (9) switches are shown in the closed position.

The embodiments disclosed are merely some examples of the various ways in which the invention can be practiced and are not intended to limit the scope of the invention.

What is claimed is:

1. A high voltage in-line air break disconnect switch operatively supported and suspended by and mounted in-line with an electric power line conductor, the high voltage in-line air break disconnect switch having an open non-conductive position and a closed conductive position, the high voltage in-line air break disconnect switch including an elongated strain insulator operatively supported and suspended by the electric power line conductor, an elongated rotating switch blade extending in parallel spaced relationship with and supported by the elongated strain insulator at each end thereof, the elongated rotating switch blade including a hinge contact end and a break jaw contact end, a hinge contact in operative electric circuit arrangement with the elongated rotating switch blade at the hinge end thereof, the hinge contact in operative supportive relationship with a hinge pin, the hinge pin in rotatable supportive relationship with the elongated switch blade at the hinge end, a hinge contact terminal including an integral hinge and a break jaw contact terminal including an integral break jaw operatively supported by the elongated strain insulator at one end thereof, the break jaw contact end of the elongated switch blade in operative electric circuit arrangement with the break jaw contact terminal when the high voltage in-line air break disconnect switch is in the closed position, a first electrical connection in operative electric circuit arrangement between the electric power line conductor and the hinge contact terminal and a second electrical connection in operative electric circuit arrangement between the electric power line conductor and the break jaw contact terminal, the improvement which comprises:

the conductor suspended high voltage in-line air break disconnect switch further comprising a motor operatively affixed to the elongated strain insulator proximate the hinge contact end in operative arrangement with an output shaft operatively mounted on the elongated strain insulator, the output shaft axially aligned with a rotating hinge axis of the hinge pin, the switch mounted motor configured to rotate the hinge end of the elongated rotating switch blade upon the motor actuation into operative electric closed circuit arrangement with the break jaw contact in the closed conductive switch position and the elongated strain insulator mounted motor configured to rotate the hinge end of the elongated rotating switch blade via the elongated strain insulator mounted output shaft upon motor actuation out of operative electric closed circuit arrangement with the break jaw contact into the open non-conductive switch position, a communication system including a plurality of communication devices configured to actuate the elongated strain insulator mounted motor as desired to rotate the elongated rotating switch blade via the elongated strain insulator mounted output shaft into operative electric closed circuit arrangement with the break jaw contact in the closed conductive switch position and to rotate the elongated rotating switch blade via the elongated strain insulator mounted output shaft out of operative electric closed circuit arrangement with the break jaw contact into the open non-conductive switch position, and, an energy supply configured to power the elongated strain insulator mounted motor and the communication system.

2. The conductor suspended high voltage in-line air break disconnect switch of claim 1, wherein the plurality of communication devices includes three short range radios to operate three switches of a three phase circuit in unison or separately and a long range radio to communicate with a utility control room to command the open or close operation of the switches.

3. The conductor suspended high voltage in-line air break disconnect switch of claim 1, wherein the energy supply comprises at least one solar charged battery connected in operative arrangement with the elongated strain insulator mounted motor and the communication system.

4. The conductor suspended high voltage in-line air break disconnect switch of claim 3, wherein the energy supply further comprises at least one solar panel connected in operative arrangement with the at least one solar charged battery, the elongated strain insulator mounted motor and the communication system.

5. The conductor suspended high voltage in-line air break disconnect switch of claim 3, further comprising a current transformer in operative arrangement with the at least one solar charged battery.

6. The conductor suspended high voltage in-line air break disconnect switch of claim 1, wherein the conductor suspended in-line air break disconnect switch is a vertical break disconnect switch.

7. The conductor suspended high voltage in-line air break disconnect switch of claim 1, wherein the conductor suspended in-line air break disconnect switch is a side break disconnect switch.

8. The conductor suspended high voltage in-line air break disconnect switch of claim 1, wherein the elongated strain insulator mounted motor includes an elongated strain insulator mounted motor output shaft configured to be coupled to a worm drive.

9. The conductor suspended high voltage in-line air break disconnect switch of claim 8, wherein the worm drive includes a worm carried on the elongated strain insulator mounted motor output shaft and a worm gear carried on the elongated strain insulator mounted hinge output shaft in operative relationship with the worm to open and close the switch blade.

10. The conductor suspended high voltage in-line air break disconnect switch of claim 8, wherein a manual operating eye ring is attached to an end of the motor output shaft.

11. The conductor suspended high voltage in-line air break disconnect switch of claim 2, wherein the communication system further includes a remote terminal unit configured to translate a radio signal to operate an electric control circuit to actuate the elongated strain insulator mounted motor motion.

12. The conductor suspended high voltage in-line air break disconnect switch of claim 6, further including a housing adapted to fit over the hinge end of the conductor suspended high voltage in-line air break disconnect switch.

13. The conductor suspended high voltage in-line air break disconnect switch of claim 7, further including a housing under the hinge end operatively attached to one end of the elongated strain insulator below the switch blade.

14. The conductor suspended high voltage in-line air break disconnect switch of claim 13, wherein at least one of the solar panels is attached to the housing.

15. The conductor suspended high voltage in-line air break disconnect switch of claim 2, further including a ground level enclosure for housing the long range radio for communicating with the utility control room radio and a ground level short range radio to communicate with over head switch controls for operating a three phase switch arrangement.

16. The conductor suspended high voltage in-line air break disconnect switch of claim 15, wherein at least one solar panel is mounted at ground level and is for powering the long range radio and the ground level short range radio.

17. The conductor suspended high voltage in-line air break disconnect switch of claim 1, further including an arc extinguishing device including a quick break whip operatively attached to the switch blade.

18. The conductor suspended high voltage in-line air break disconnect switch of claim 1, further including a vacuum interrupter operatively attached to the switch and configured to be actuated by the rotating switch blade.

19. A switching arrangement for a high voltage electric utility three phase system, including two or three high voltage in-line communication system controlled motorized air break disconnect switches of claim 1 each operatively supported and suspended by and mounted in-line with an electric power line conductor, each of the conductor suspended high voltage in-line disconnect switches operatively mounted in one of the three phases to form a two way or three way switch array, each of the conductor suspended high voltage in-line disconnect switches includes the suspended elongated strain insulator in supportive relationship with ft the switch blade and the elongated strain insulator mounted motor in operative relationship with the switch blade, one of the conductor suspended in-line disconnect switches per phase includes a long range radio for distance transmitting to a utility control room radio, and the conductor suspended in-line disconnect switches each includes a short range radio for communicating with the other of the conductor suspended in-line disconnect switches of the two way or three way switch array and for actuating the respective conductor suspended in-line disconnect switch by energizing the respective motor, whereby the high voltage in-line air break disconnect switches of the two way or three way switch array may be actuated simultaneously.

20. The switching arrangement for a high voltage electric utility three phase system of claim 19, further including a second strain insulator per respective conductor suspended in-line disconnect switch, the second strain insulator for each respective conductor suspended in-line disconnect switch is affixed at one end to a utility pole or structure and at the other end to the first strain insulator of the respective conductor suspended in-line disconnect switch.

21. The switching arrangement for a high voltage electric utility three phase system of claim 19, further includes end of switch contact conductors operatively attached between switch contact terminals of each of the respective two way or three conductor suspended in-line disconnect switches for carrying electric power line current in two or three directions.

22. The switching arrangement for a high voltage electric utility three phase system of claim 19, wherein the conductor suspended high voltage in-line air break disconnect switches comprise vertical break switches.

23. The switching arrangement for a high voltage electric utility three phase system of claim 22, wherein each of the vertical break switches further include an arc extinguishing device including a quick break whip or vacuum interrupter operatively attached to the switch and configured to be actuated by the rotating switch blade.

24. The switching arrangement for a high voltage electric utility three phase system of claim 19, wherein the conductor suspended high voltage in-line air break disconnect switches comprise side break switches.

25. The switching arrangement for a high voltage electric utility three phase system of claim 24, wherein each of the side break switches further including a quick break whip or vacuum interrupter and a housing operatively attached to one end of the strain insulator below the switch blade.

26. The switching arrangement for a high voltage electric utility three phase system of claim 25, further including at least one solar panel operatively attached to a side of the housing.

27. A three way or two way switching arrangement for a high voltage electric utility three phase system, each of the phases including respectively a three way or two way switching arrangement including respectively three or two radio controlled motorized in-line side air break disconnect switches, each of the switches including a switch blade and a motor for actuation of the switch blade operatively controlled by a short range radio, each of the switching arrangements including a first long range radio in operative communication with a utility control room radio, each of the radio controlled motorized in-line side air break disconnect switches including a first strain insulator in supportive relationship with the switch blade, the motor in operative relationship with the switch blade, the three way or two way switching arrangements are mounted in switch arrays to a utility pole or structure in a phase over phase relationship.

28. The three way or two way switching arrangement for a high voltage electric utility three phase system of claim 27, wherein each of the in-line side air break disconnect switches further include an arc extinguishing device including a quick break whip or vacuum interrupter operatively attached to the switch.

29. The three way or two way switching arrangement for a high voltage electric utility three phase system of claim 27, wherein each of the side break switches further including a housing operatively attached to one end of the strain insulator below the switch blade.

30. The three way or two way switching arrangement for a high voltage electric utility three phase system of claim 27, further including at least one solar panel operatively attached to the housing.

31. The three way or two way switching arrangement for a high voltage electric utility three phase system of claim 27, further including a second strain insulator per respective in-line disconnect switch, the second strain insulator for each respective in-line disconnect switch is affixed at one end to the utility pole or structure and at the other end to the first strain insulator for the respective in-line disconnect switch.

32. The three way or two way switching arrangement for a high voltage electric utility three phase system of claim 27, further including conductors operatively attached between switch terminals of each of the respective switches for carrying electric power line current.

* * * * *